United States Patent [19]

Kosicki et al.

[11] 4,055,020

[45] Oct. 25, 1977

[54] GAS-FILLED RESILIENT DOLL WITH MOVABLE HEAD AND LIMBS

[75] Inventors: Witold W. Kosicki, Columbia; Charles M. Hollingsworth, West Columbia, both of S.C.

[73] Assignee: Horsman Dolls Inc., Columbia, S.C.

[21] Appl. No.: 669,290

[22] Filed: Mar. 22, 1976

[51] Int. Cl.[2] ..... A63H 3/06; A63H 3/46

[52] U.S. Cl. ..... 46/161; 46/90; 46/163; 264/96

[58] Field of Search ..... 46/161, 162, 163, 164, 46/87, 88, 173, 90

[56] References Cited

U.S. PATENT DOCUMENTS

| | | | |
|---|---|---|---|
| 3,699,715 | 10/1972 | Lewis et al. | 46/163 |
| 3,881,276 | 5/1975 | Kosicki et al. | 46/162 |

*Primary Examiner*—F. Barry Shay
*Attorney, Agent, or Firm*—Shenier & O'Connor

[57] ABSTRACT

A gass-filled doll having articulated limb joints in which each of the individual torso and limb members is made up of a soft gas impervious skin filled with gas under superatmospheric pressure and the skin of each of which limb members at a limb joint location is formed with a recess for receiving a joint-forming element and in which each skin recess of the limb members is formed with an opening for admitting air to the member and for receiving a sealing element over which the joint forming element is secured after the member has been pressurized. In one embodiment of the invention the member is cooled with the skin recess open, a plug is cemented in the opening while the member is cool, the member is allowed to come to room temperature and the joint forming element is cemented in place over the plug. Alternatively, each of the recess openings may be provided with a self-sealing plug through which gas under pressure may be supplied by means of a needle, thus doing away with the necessity for cooling the member.

6 Claims, 4 Drawing Figures

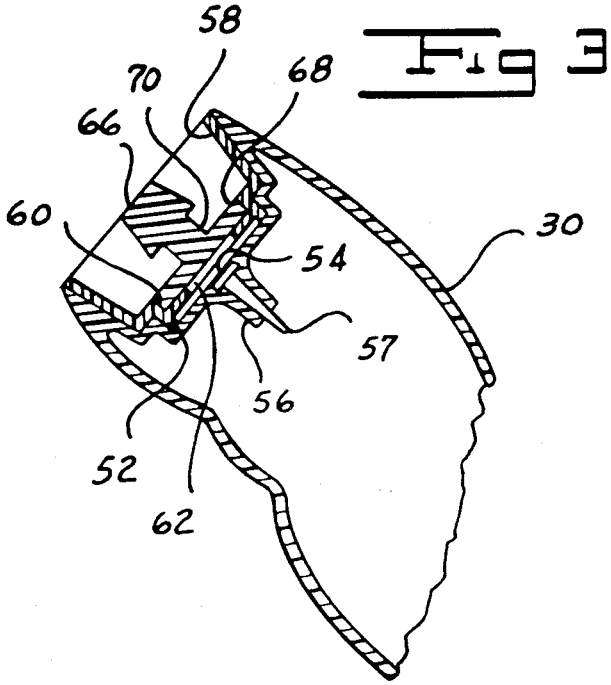
Fig 3
Fig 4
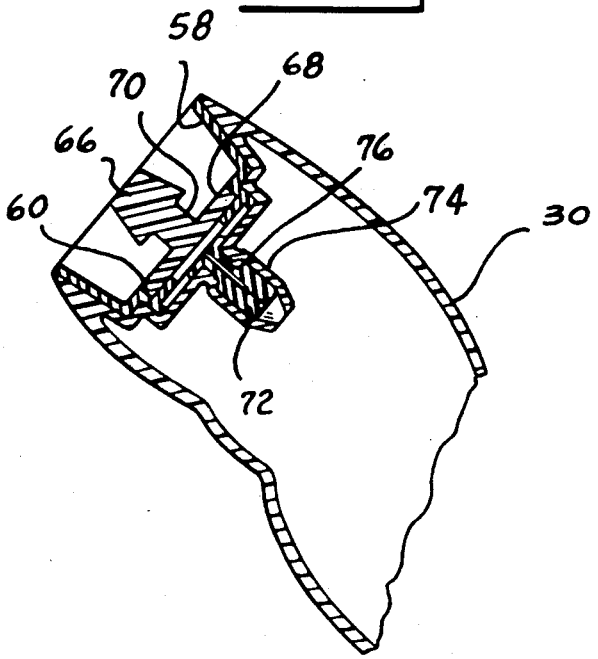

GAS-FILLED RESILIENT DOLL WITH MOVABLE HEAD AND LIMBS

BACKGROUND OF THE INVENTION

Various types of dolls are known in the prior art. In recent years the trend has been away from dolls the bodies of which are formed from hard, rigid materials and toward dolls which more realistically simulate the feel or "handle" of a live baby. These dolls fall into two general categories. The first of these includes dolls, the bodies of which are formed by skins of a relatively soft pliable material such as a suitable grade of polyvinyl chloride and the skin is filled with a fluid, such as air at a pressure sufficient to simulate the consistency of a live baby. Usually such dolls are made with unitary skins including at least all of the torso and limbs of gas filled dolls by individually sealing the torso and limbs and then pivotally interconnecting the limbs and torsos have resulted in joints which are unsightly and unrealistic.

The second category of dolls which have a realistic feel and at the same time are articulated with realistic and attractive joints customarily include a torso and limbs which are individually formed with soft pliable skins which are filled with a suitable foamed synthetic resin before the relatively rigid joint forming elements are assembled on the limbs and torso. A doll of this type is shown and described in our application Ser. No. 459,271, filed Apr. 9, 1974, now U.S. Pat. No. 3,881,276. While a doll of this type successfully simulates the feel of a live baby while at the same time being articulated with attractive and realistic limb joints, it is relatively expensive to construct, owing to the necessity for performing the foam filling operation and the cost of the filling material.

We have invented a doll having both a natural feel and articulated joints which overcomes the defects of the prior art pointed out hereinabove. Our doll is simple to make than are natural feeling articulated dolls of the prior art. It is less expensive to manufacture than are natural feeling and attractive articulated dolls of the prior art.

SUMMARY OF THE INVENTION

One object of our invention is to provide a gas-filled articulated doll.

Another object of our invention is to provide a natural feeling attractive articulated doll which is less expensive to produce than are natural feeling articulated dolls of the prior art.

A further object of our invention is to provide a gas-filled limb assembly for a resilient articulated doll.

Yet another object of our invention is to provide a gas-filled limb assembly for a resilient articulated doll having an effective seal.

A still further object of our invention is to provide a gas-filled limb assembly for a resilient articulated doll having a seal which is esthetically pleasing.

Other and further objects of our invention will appear from the following description.

In general, our invention contemplates the provision of a natural feeling attractive articulated doll, comprising a hollow limb member formed of a relatively soft, air-tight material and filled with a pressurized gas, the limb member having a joint end formed with a recess having a first central opening receiving a sealing member comprising either a peg or a self-sealing plug to seal said opening. A relatively rigid, cup-shaped socket member formed with a central recess having a second central opening larger than the first central opening is mounted in the limb recess over the first central opening and sealing member. A joint member having a base, a plug for engaging a torso-mounted joint receiving member for rotation therewith, and a neck connecting the plug to the base is mounted in the central recess of the socket member.

BRIEF DESCRIPTION OF THE DRAWINGS

In the accompanying drawings which form part of the instant specification and which are to be read in conjunction therewith and in which like reference numerals are used to indicate like part in the various views:

FIG. 3 is a sectional view of another embodiment of our limb assembly for our doll.

FIG. 4 is a sectional view of a further embodiment of this limb assembly of our doll.

DESCRIPTION OF THE PREFERRED EMBODIMENT

Figure 1:
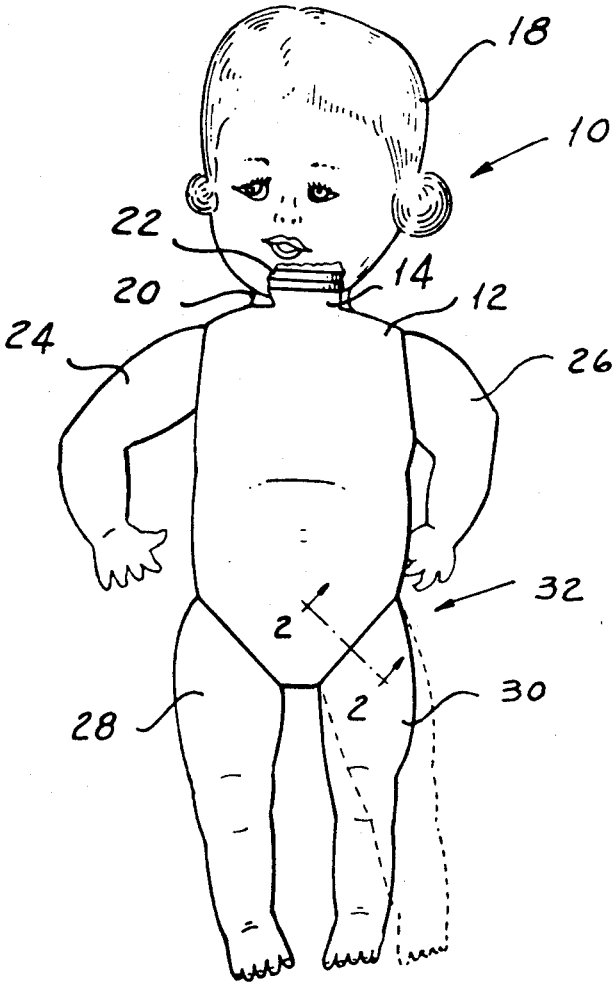
FIG. 1 is a front elevational view of our natural feeling attractive articulated doll with a part broken away.
Figure 2:
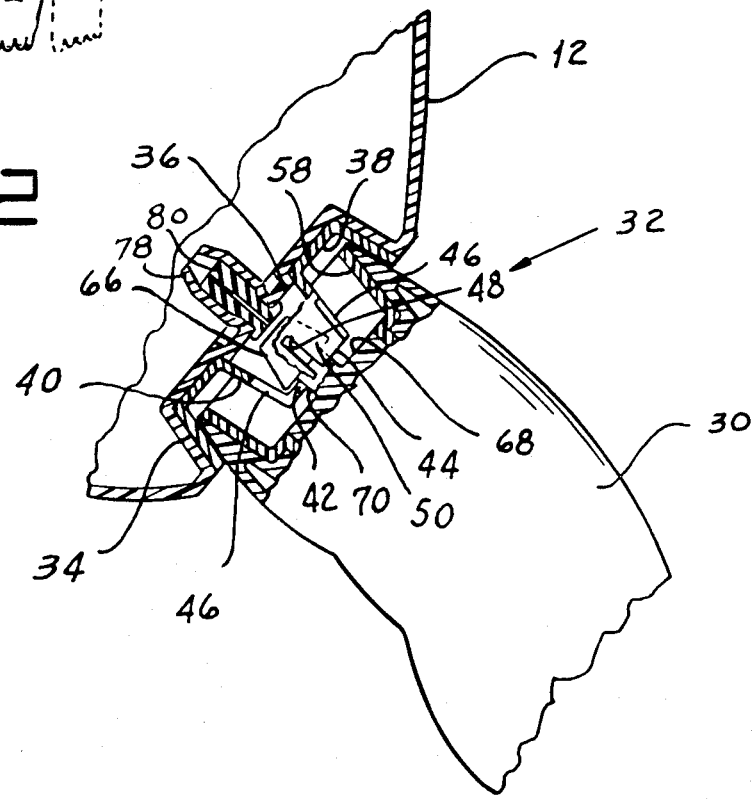
FIG. 2 is a sectional view of a leg joint of the doll shown in FIG. 1 taken along line 2—2 of FIG. 1, illustrating one form of our invention.

Referring now to FIGS. 1 to 3, a doll, indicated generally by the reference character 10, incorporating our attaching means includes a torso 12, the skin of which is molded from a suitable soft synthetic resin such as polyvinyl chloride by any appropriate molding method. Preferably we rotationally mold the torso 12. The torso 12 is formed with a head support 14 opening into the interior of the skin and provided with a peripheral retaining flange 22 adapted to be inserted within the head 18 so as to retain the head on the body in a manner known to the art. The neck 20 formed as an integral part with the head extends down to the shoulder portion of the torso. We fill the torso 12 of our doll with air under sufficient pressure to give the doll sufficient substance to simulate a natural feel. Where the head is assembled on the body in the manner shown in FIG. 1, we may, for example, introduce air under pressure through a blank flange 22 secured in air-tight relationship over the top of the head support 14. Alternatively as when the head might be made unitary with the body, or for any other reason, we may, in accordance with our invention, introduce air under pressure into the torso at one of the leg joints.

The doll 10 includes a right arm 24, a left arm 26, a right leg 28, and a left leg 30. All of these limbs are secured to the torso 12 by one of the forms of our limb attaching means to be described in detail hereinbelow.

One of our attaching means indicated generally by the reference character 32 secures the left leg 30 to the torso 12. In the course of molding the skin of the torso 12, we form a recess 34 in the left hip region of the torso. Similar recesses are formed at the locations at which the right arm, the right leg and the left arm are to be secured to the torso. If desired, we may provide the recess 34 with a central locating boss 36. The attaching means 32 includes a joint member in the form of cup-shaped torso socket member 38 which may, for example, be injection molded from a polyvinyl chloride to form an element which is rigid as contrasted with the soft vinyl skin. We mold the member 38 with a central joint receiving member such as a boss 40 having a frustoconical shape. We form a central opening 42 in the top wall 44 of the boss 40. At the same time, in the course of the molding operation, we form opposite pairs of slots 46 and 48 which divide the upper portion of the boss into a plurality of resilient fingers 50. In molding the member 38 we form the top 44 of the boss 40 with a thickness which tapers from a generally thicker region adjacent to the hole 42 to a thinner region at the periphery for a reason to be explained hereinbelow. As will be explained hereinbelow, we cement the members 38 associated with the arms and legs in place in the recesses provided therefor.

Referring to FIGS. 2 and 3, we form the joint end of the leg 30, to be attached to the torso 12, with a recess 52 having a central opening 54 for filling the interior of the limb with air. The opening 54 is provided with an inwardly-extending collar 56 for receiving a sealing member such as a peg 57.

We injection mold a cup-shaped limb socket member 58 provided with a central recess 60 surrounding a central opening 62. Before filling the leg 30 in a manner to be described, we cement the cup-like member 58 in the recess 52 with openings 54 and 62 in registry. Another joint member comprising an injection molded plug 66 connected to a base plate 68 by a neck 70 is adapted to be cemented in position within the recess 60 after the leg has been filled with air. We may form the parts 38, 58 and 66 from any suitable material such, for example, as "CYCOLAC" which is the registered trademark of Marbon Chemical Division, Borg-Warner Corporation, of Gary, Ind., for a high-impact, styrene-type, rigid thermoplastic resin suitable for injection molding.

In making a doll incorporating our means 32 for attaching the limbs thereto, we first make the head in the usual manner and then mold the skins of the torso 12, arms 24 and 26, and legs 28 and 30, from a material such as soft polyvinyl chloride by a rotational molding technique. Next, we injection mold the relatively rigid parts including the cup-like member 38 having the boss 40 with its top 44 having an opening 42 as well as slots 46 and 48 providing the resilient fingers, the cup-like member 58 having the recess 60 with the filling opening 62 and the plug 66 connected by the neck 70 to the base 68. After those parts have been injection molded, the members 38 and 58 are adhered in the respective recesses 34 and 52 in the torso and in the ends of the limbs. It will readily be appreciated that the elements making up the leg-connecting means are the same as those making up the arm-connecting means but are of a somewhat larger size. Further in adhering the member 58 in the recess 52 the openings 62 and 54 are aligned.

Next, the filling operation takes place. In the form of our gas-filled doll illustrated in FIG. 3, we fill the limbs, such, for example, as the leg 30 with air by first chilling the vinyl skin 30 while allowing air or other gas at normal atmospheric pressure to enter the interior of the leg through the central opening 54. When the air in the interior has become suitably chilled, the opening 54 is sealed by pressing the peg 57 into the opening 54 so that it engages the collar 56 with an air-tight seal. We then cement the peg 57 to the skin 30 to make the seal permanent. Next, the base 68 is inserted in the recess 60 and adhered in place by use of a suitable cement. When the sealed air or gas in the leg 30 warms to room temperature, it will try to expand and thereby pressurize the interior of the leg 30.

When all of the parts have thus been made and filled, the neck portion of the head 18 is assembled over the flange 16. Similarly, the plugs 66 of all of the limbs are inserted in the openings 42 of their associated socket members 38. The doll is now completely assembled.

In use of a doll incorporating our means for attaching the limbs thereto, each limb is capable of a full 360° of rotation around an axis which is substantially that of the neck 70 connecting the plug 66 to base 68. In addition, our construction permits of a limited movement of the limb in a direction perpendicular to the axis of pivotal movement. By way of example, we have illustrated an alternate position of the left leg 30 in broken lines in FIG. 1. All this is achieved while providing a tightly sealed limb filled with gas under pressure to give a natural feel. At the same time the filling and sealing means is concealed from view.

Referring now to FIG. 4, we show an alternative embodiment of our limb assembly, which is substantially identical to the embodiment shown in FIG. 3, but uses a self-sealing plug 72 as a sealing member rather than the peg 57. The self-sealing plug 72, which is of a type known to the art, is retained by an inwardly extending collar 74 formed around the central opening 76 of the skin 30.

The use of the self-sealing plug 72 allows the filling step to be performed at room temperature. More particularly, after the socket member 58 is cemented to the limb 30 and the plug 72 is inserted into the opening 76, the limb 30 may be inflated by injecting a needle into the self-sealing plug 72 and supplying the needle with pressurized air or gas. Thereafter the base 68 is cemented in the recess 60 as before.

The operation of filling the torso 12 with gas under pressure may be accomplished in various ways, depending in some degree on the manner in which the head 18 is joined to the torso 12. If the arrangement is such as shown in FIG. 1, in which the head is assembled over the head support 14 gas under pressure may be introduced into the torso 12 through any suitable valve means carried by the blank flange 22 which is adhered over the head support 14. Alternatively the torso could be chilled with the head support 14 open, the blank 22 adhered over the support 14 while the body is chilled and then the torso be permitted to come to ambient temperature to cause the air to expand to give the torso the desired natural feel. In each of these methods the skin of the torso completely covers each of the socket recesses of the torso.

As an alternative to the modes of pressurizing the torso described hereinabove, in an instance for example where the connection of the head to the torso does not permit of the use of the above described method, we may pressurize the torso 12 by either of the means which we have described in connection with the pressurizing of the limbs. For example, referring again to FIG. 2 we may form the torso leg socket boss 36 with a passage forming inwardly directed extension 78 adapted to receive a self-sealing plug 80 similar to the plug 72. When the torso is to be filled a hollow needle connected to a source of gas under pressure can be inserted through the plug and maintained therein until the desired pressure is reached. Alternatively, the torso could be chilled and a plug such as plug 57 inserted into the extension 78 while the torso was chilled. It will readily be appreciated that in both these last described methods of pressurizing the torso 12, the neck region of the doll is hermetically sealed.

It will be seen that we have accomplished the objects of our invention. We have provided a gas-filled articulated doll which is both esthetically attractive and which simulates a natural feel. Our natural feeling and esthetically attractive articulated doll is less expensive to produce than are natural feeling articulated dolls of the prior art. Our construction provides a hermetic seal which is effective over a long period of time.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a doll assembly including a sealed, gas-filled hollow body member formed by a soft and pliable gas-impervious skin, a joint member receiving recess in said skin, said recess having a wall including side and bottom portions and being formed with an opening in said wall for admitting gas under pressure into said body member, sealing means in said opening for sealing against the sides of said opening to retain gas under pressure in said body member, means for joining said body member to another part of said doll including a joint member formed of relatively rigid material, and means mounting said joint member in said recess over said sealing means.

2. An assembly as in claim 1, in which the sealing means is a self-sealing plug.

3. An assembly as in claim 1, in which the sealing means is a peg.

4. An assembly as in claim 1, in which said recess includes an inwardly extending collar for receiving said sealing means.

5. An assembly as in claim 1 in which said mounting means comprises a cup-like member of relatively rigid material having an opening in the base thereof, said cup-like member being mounted in said limb recess with the opening thereof registering with said skin recess opening, said joint element being assembled in said cup-like member over the opening therein.

6. A natural feeling articulated doll assembly including in combination, a torso formed by a skin of soft, pliable, gas-impervious material, a head carried by said torso, said torso being provided with first joint member receiving recesses at the shoulders and hips thereof, means on said torso forming an opening for the introduction of gas under pressure into said torso, means for sealing said torso opening to retain gas under pressure in said torso, respective hollow arm and leg limb members, each of said limb members being formed by a gas-impervious skin of soft pliable material and being provided with a second joint member receiving recess in said skin at the joint end of said limb member, each of said second joint member receiving recesses having a wall including side and bottom portions and being formed with an opening in said wall for the introduction of gas under pressure into the limb, means for sealing against the sides of said second joint member receiving recess openings to retain gas under pressure within the limbs, respective first joint forming members of relatively rigid material, means mounting said first joint forming members in said first joint member receiving recesses over the sealing means therein, a plurality of second joint forming members, and means mounting said second joint forming members in said second joint member receiving recesses over the sealing means therein, said first and second joint forming members cooperating to form articulated shoulder and hip joints concealed within said recesses.

* * * * *